US010259620B2

(12) United States Patent
Matthis

(10) Patent No.: US 10,259,620 B2
(45) Date of Patent: Apr. 16, 2019

(54) LID ASSEMBLY FOR A CONTAINER

(71) Applicant: IGNITE USA, LLC, Chicago, IL (US)

(72) Inventor: Marjavis J. Matthis, Chicago, IL (US)

(73) Assignee: IGNITE USA, LLC, Chicago, IL (US)

( * ) Notice: Subject to any disclaimer, the term of this patent is extended or adjusted under 35 U.S.C. 154(b) by 109 days.

(21) Appl. No.: 15/060,580

(22) Filed: Mar. 3, 2016

(65) Prior Publication Data

US 2017/0253395 A1 Sep. 7, 2017

(51) Int. Cl.

| | |
|---|---|
| ***B65D 47/08*** | (2006.01) |
| ***A47G 19/22*** | (2006.01) |
| ***B65D 43/02*** | (2006.01) |
| ***A45F 3/16*** | (2006.01) |

(52) U.S. Cl.

CPC ..... *B65D 47/0866* (2013.01); *A45F 3/16* (2013.01); *A47G 19/2272* (2013.01); *B65D 43/02* (2013.01)

(58) Field of Classification Search

CPC ..... A47G 19/2272; B65D 43/02; B65D 47/0866; A45F 3/16

USPC ..... 222/153.13–153.14; 220/703, 707, 709, 220/710.5, 711, 713–715, 724–728

See application file for complete search history.

(56) References Cited

U.S. PATENT DOCUMENTS 4,664,139 A * 5/1987 Pfeiffer ..... B01J 8/082 137/240
4,712,704 A * 12/1987 Ramsey ..... A47G 19/2272 220/254.4
D564,841 S 3/2008 Clemens et al.
D584,566 S 1/2009 Fuller
7,546,933 B2 * 6/2009 Pinelli ..... A47G 19/2272 220/714
D649,879 S 12/2011 Gullickson et al.
D651,847 S 1/2012 Gilbert
D686,448 S 7/2013 Boroski
(Continued)

FOREIGN PATENT DOCUMENTS

CN 201806141 U 4/2011
CN 201948619 U 8/2011
(Continued)

OTHER PUBLICATIONS

Avex 24 oz. Brazos Autoseal Stainless Water Bottle, downloaded from the Internet at: <http://www.avexoutdoor.com/24-oz-brazos-autoseal-water-bottle.html> (admitted prior art).

(Continued)

*Primary Examiner* — Paul R Durand
*Assistant Examiner* — Andrew P Bainbridge
(74) *Attorney, Agent, or Firm* — Marshall, Gerstein & Borun LLP

(57) ABSTRACT

A lid assembly for a container includes a seal assembly coupled to a base portion, and the seal assembly includes an intermediate arm pivotably coupled to the base portion and an engagement portion disposed adjacent to a second end. The seal assembly also includes a plunger arm pivotably coupled to the intermediate arm and a seal member disposed on the plunger arm. Displacing a button member coupled to the base portion actuates the seal assembly from a closed first position in which the seal member seals a fluid aperture formed in a spout of the base portion to an open second position in which the fluid aperture is not sealed.

22 Claims, 10 Drawing Sheets

(56) References Cited

U.S. PATENT DOCUMENTS

| | | | | |
|---|---|---|---|---|
| 8,727,176 | B2 * | 5/2014 | El-Saden | A47G 19/2272 215/228 |
| 8,839,983 | B2 | 9/2014 | Chiou et al. | |
| 8,844,762 | B2 * | 9/2014 | Chiou | B65D 43/02 215/305 |
| 8,863,979 | B2 | 10/2014 | El-Saden et al. | |
| D730,694 | S | 6/2015 | Elsaden et al. | |
| D740,605 | S | 10/2015 | Wodka et al. | |
| D747,136 | S | 1/2016 | Lane et al. | |
| D748,943 | S | 2/2016 | Miller et al. | |
| 9,462,904 | B2 * | 10/2016 | Coon | A45F 3/18 |
| D770,222 | S | 11/2016 | Boroski et al. | |
| D771,990 | S | 11/2016 | Horowitz | |
| D772,022 | S | 11/2016 | Cornu et al. | |
| 9,706,863 | B2 * | 7/2017 | Huang | A47G 19/2288 |
| 2012/0326062 | A1 * | 12/2012 | Wieland | F16K 11/07 251/12 |
| 2014/0197170 | A1 * | 7/2014 | Carlile | B65D 47/249 220/262 |
| 2015/0014339 | A1 | 1/2015 | Chiou et al. | |
| 2015/0028044 | A1 | 1/2015 | El-Saden et al. | |
| 2015/0201773 | A1 | 7/2015 | Sorensen et al. | |
| 2015/0201776 | A1 * | 7/2015 | Elsaden | A47G 19/2272 220/715 |
| 2015/0360927 | A1 | 12/2015 | Sweeney et al. | |

FOREIGN PATENT DOCUMENTS

| | | | |
|---|---|---|---|
| CN | 203058744 | U | 7/2013 |
| CN | 104825025 | A | 8/2015 |
| EM | 003358092-0002 | | 8/2016 |

OTHER PUBLICATIONS

Avex Autoseal® Insulated Brazos Product Sheet (admitted prior art).

Canadian Patent Application No. 2959607, Examination Report, dated Jan. 8, 2018.

European patent application No. 17159189.4, Extended European Search Report, dated Jul. 17, 2017.

25 Oz. Brazos Autoseal® Water Bottle, posted at Avexoutdoor.com, no posting date given, © 2009-2016, site visited Dec. 14, 2016, <http://www.avexoutdoor.com/bpa-free-bottles-brazos-autoseal-plastic-water-bottle.html>.

Avex FreeFlow Stainless Autoseal Water Bottle, posted at Amazon.com, posted on Apr. 18, 2016, <https://www.amazon.com/gp/product/B01BEX7LPS/ref=as_li_of_sp_asin_il_tl?ie=UTF8&camp=1789&creative=9325&creative ASIN=B01BEX7M5W&linkCode=as2&tag=blesthisstuf-20&linkId=00YOAFOSHIV243QA&th=1>.

Contigo Auto Seal Cortland Water Bottle, 24-Ounce, Smoke, posted at Amazon.com, posted on Feb. 4, 2015, site visited Dec. 14, 2016, <https://www.amazon.com/dp/BOOT7MMUFU/ref=asc_df_B00T7MMCQM4697223?smid=ATVPDKIKXODER&tag=merbethomg arshape-20&linkCode=dfO&creative=395093&creativeASIN=BOOT7MMCQM&ascsubtag =119239811&th=1>.

Contigo Avex Stainless Steel Water Drink Bottle SS Autoseal BPA Free 20oz Flask, posted at Ebay.com, posted on Jun. 4, 2014, <http://www.ebay.com/itm/Contigo-Avex-Stainless-Steel-Water-Drink-Bottle-SS-AUTOSEAL-BPA-Free-20oz-Flask-/171349321808>.

* cited by examiner

LID ASSEMBLY FOR A CONTAINER

FIELD OF THE DISCLOSURE

This disclosure relates generally to a lid assembly for containers, and more particularly, to a re-closable lid assembly for beverage containers.

BACKGROUND

Refillable beverage containers, such as commuter mugs, for example, typically include a removable lid that includes a fluid aperture (e.g., a drink hole), and a user typically fills the interior of the container with a hot or cold beverage (e.g., ice water, coffee or soda) when the lid is removed. To drink the beverage, the user typically tips the container to allow the beverage to pass through the fluid aperture, and the user sips the beverage as the beverage exits the fluid aperture. The fluid aperture may be disposed at a top portion of an elongated spout formed on the removable lid, and such a configuration (known as a high user drink interface) allows the fluid aperture to be placed near—or inserted into a user's mouth without obstruction.

While such a configuration facilitates drinking, the elongated shape of the spout portion makes sealing the fluid aperture difficult. Typically, complex mechanisms are required to provide a seal that can be opened and closed by a user, and such complex mechanisms can be expensive to manufacture. In addition, because the mechanisms are disposed within the interior of the removable lid, bacteria and debris may be difficult to remove therefrom. Moreover, ice from the beverage may interfere with the operation of the mechanism, or may prevent a full sealing of the fluid aperture. Accordingly, there is a need for a removable lid having a high user drink interface that has a reliable sealing mechanism that is simple to operate and that can easily be cleaned.

BRIEF SUMMARY OF THE DISCLOSURE

A lid assembly adapted to be removably secured to a container includes a base portion having an outer surface and an inner surface, the base portion having a spout that extends along a spout axis. A fluid aperture extends through a top portion of the spout. An elongated button member is coupled to the base portion, and the button member extends along a button axis from a first end to a longitudinally-opposite second end, the button member being displaceable along the button axis from an un-actuated first position to an actuated second position. The lid assembly also includes a displaceable seal assembly coupled to the base portion and displaceable from a closed first position to an open second position. The displaceable seal assembly includes an elongated intermediate arm having a first end and a second end, the intermediate arm being pivotably coupled to the base portion at or adjacent to the first end of the intermediate arm. The intermediate arm has an engagement portion disposed at or adjacent to the second end or at between the first end and the second end. The displaceable seal assembly also includes an elongated plunger arm extending from a first end to a second end, the first end of the plunger arm being pivotably coupled to the intermediate arm at or adjacent to the second end of the intermediate arm. A seal member is disposed at or adjacent to the second end of the plunger arm, and the seal member is adapted to sealingly engage a portion of the fluid aperture when the displaceable seal assembly is in the closed first position and adapted to not sealingly engage the portion of the fluid aperture when the displaceable seal assembly is in the open second position. The engagement portion of the intermediate arm is adapted to be contacted by the first end of the button member such that when the button member displaces from the un-actuated first position to the actuated second position, the first end of the button member contacts the engagement portion of the intermediate arm and pivots the intermediate arm about the first end of the intermediate arm such that the plunger arm translates away from the fluid aperture from the closed first position to the open second position.

DETAILED DESCRIPTION

Figure 10:
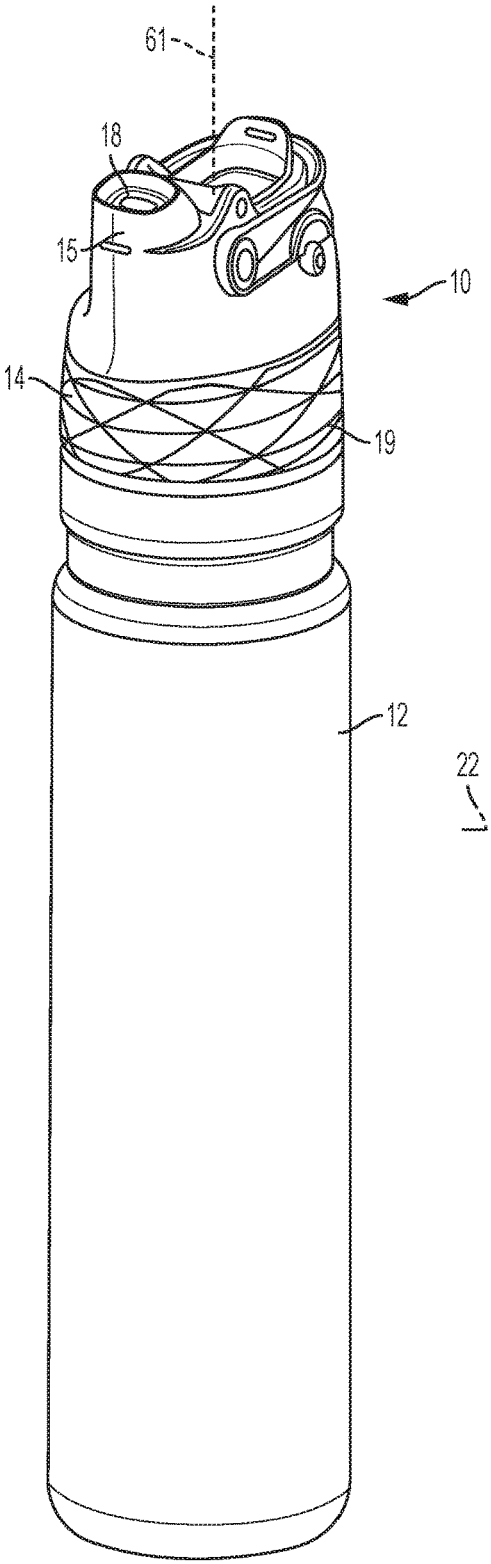
FIG. 10 is a perspective view of an embodiment of the lid assembly of FIG. 1C removably secured to a container.

Beginning with FIG. 10, a lid assembly 10 may be adapted to be removably secured to a container 12. The lid assembly includes a base portion 14 and a displaceable seal assembly 30 (not shown in FIG. 10) directly or indirectly coupled to the base portion 14 and displaceable from a closed first position (illustrated in FIG. 3A) to an open second position (illustrated in FIG. 3B). The base portion 14 includes a high drink interface, which is more desirable for a user. The high drink interface includes a spout 15 that is raised up from the base portion 14. The spout 15 protrudes from an upper surface of the base portion 14 in a direction generally away from the container 12. In one embodiment, the spout 15 forms an oblong or oval shaped fluid aperture 18. In other embodiment, the spout may take other shapes, such as a circle, a square, a polygon, etc. Regardless of the shape, the spout 15 elevates the fluid aperture above the top surface of the base portion 14, which provides easy access to liquid coming out of the spout 15 for a user.

Figure 1A:
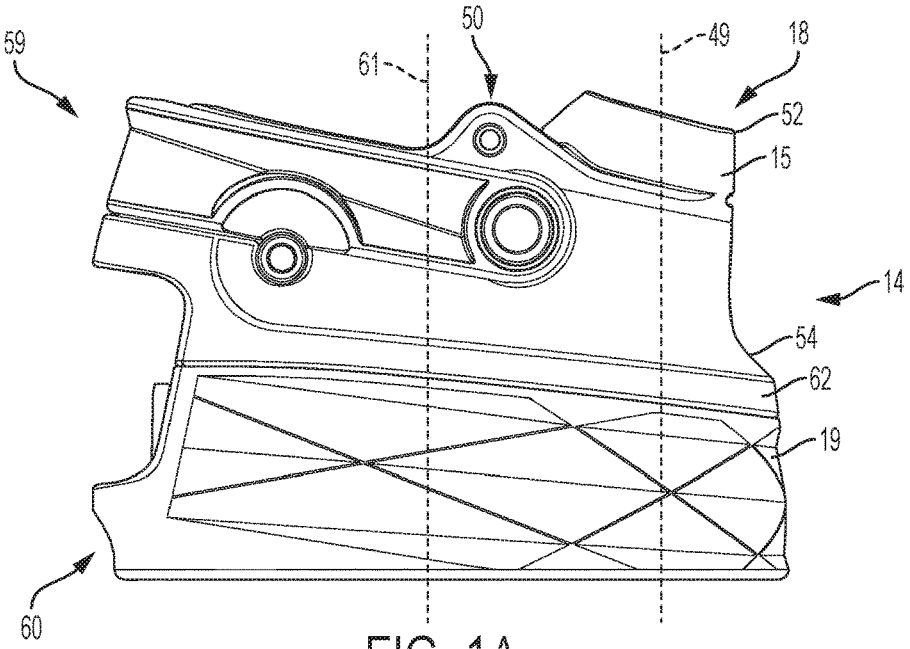
FIG. 1A is a side view of an embodiment of a base portion of a lid assembly.
Figure 1B:
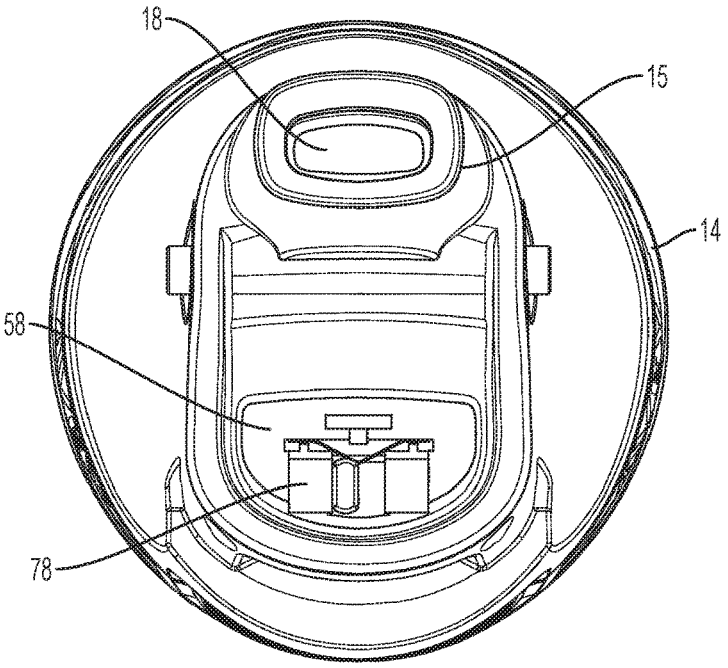
FIG. 1B is a top view of the base portion of FIG. 1A.
Figure 1C:
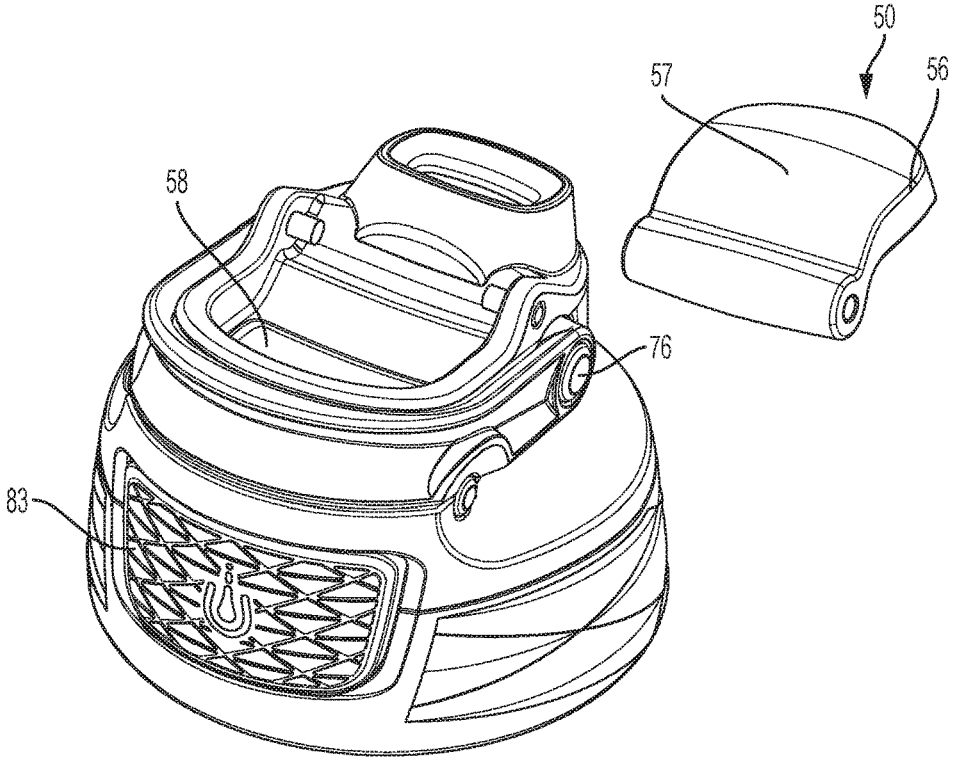
FIG. 1C is a perspective view of an embodiment of a lid assembly, including the base portion of FIG. 1A.
Figure 1D:
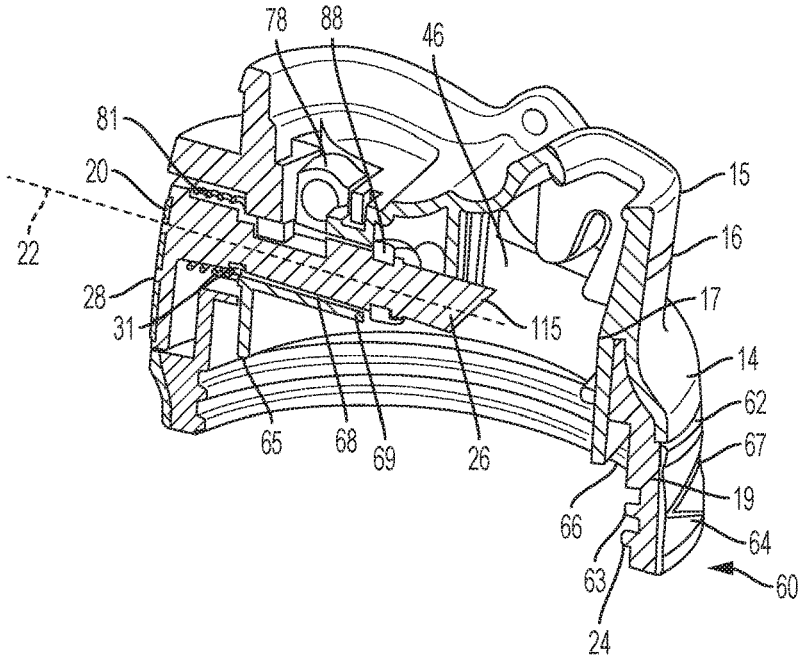
FIG. 1D is a perspective sectional view of the lid assembly of FIG. 1C.
Figure 2:
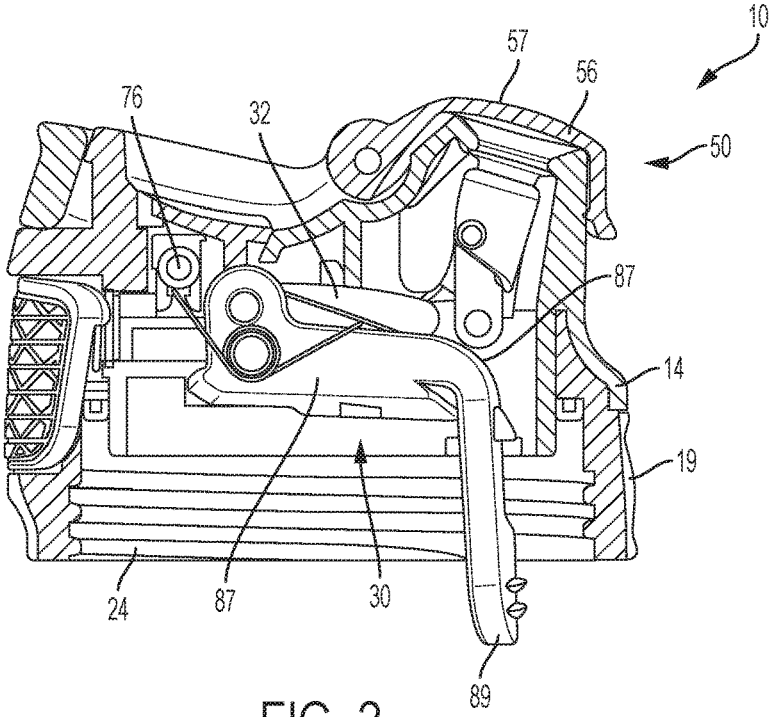
FIG. 2 is a side sectional view of the lid assembly of FIG. 1C.
Figure 3A:
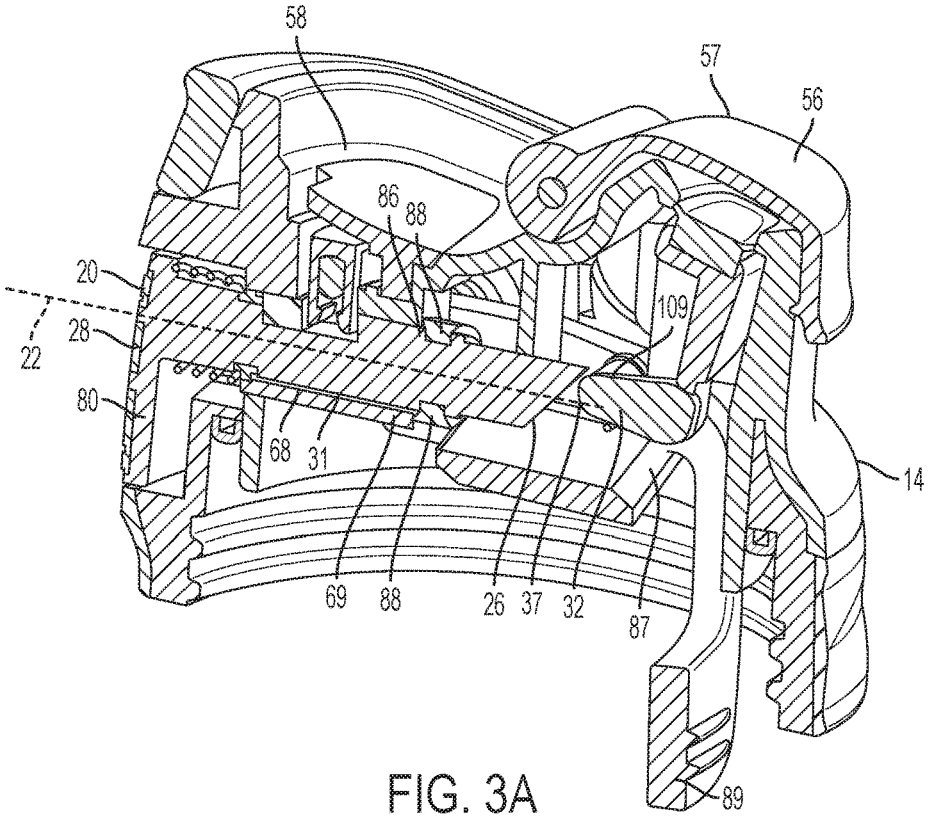
FIG. 3A is a perspective sectional view of the lid assembly of FIG. 1C, the lid assembly having a displaceable seal assembly in a closed first position.
Figure 3B:
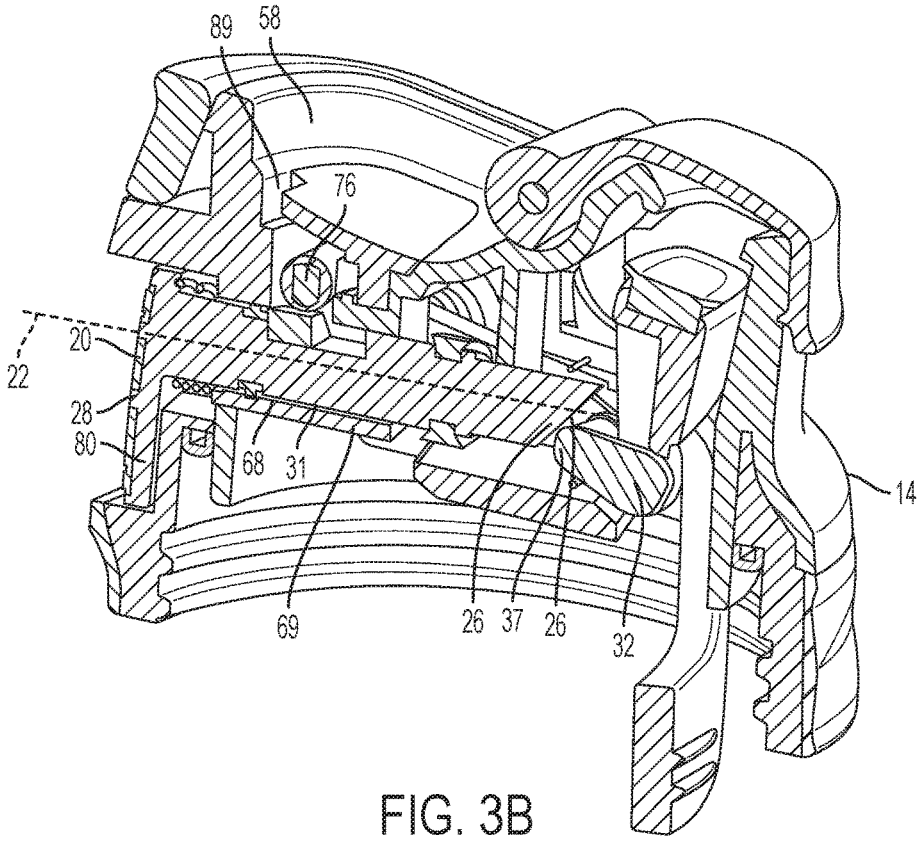
FIG. 3B is a perspective sectional view of the lid assembly of FIG. 1C, the lid assembly having the displaceable seal assembly in an open second position.

Turning now to FIGS. 1A and 2, the base portion 14 includes the spout 15 that extends upward, away from the base portion 14 along a spout axis 49, and a fluid aperture 18 extends through a top 50 of the spout 15. The top edge of the spout 15 may be angled (non-perpendicular and non parallel) to the spout axis 49, as illustrated in FIG. 1. However, in other embodiments, the top edge of the spout 15 may be perpendicular to the spout axis. The base portion 14 may also include a skirt 19 that is removably attached to the base 12, for example by a threaded surface 24 (illustrated in FIGS. 1D and 2), and a portion of the threaded surface 24 may be adapted to engage a threaded portion (not shown) of the container 12. In other embodiment, other types of removable connections may be used to join the base 14 portion and the container 12. As illustrated in FIG. 1D, 3A and 3B, an elongated button member 20 is coupled to the base portion 14, and the button member 20 extends along a button axis 22 from a first end 26 to a longitudinally-opposite second end 28. The button axis 22 may be disposed at an angle, of between about 90° and about 45°, for example, relative to the spout axis 49. The button member 20 is displaceable along the button axis 22 from an unactuated first position (illustrated in FIG. 3A) to an actuated second position (illustrated in FIG. 3B).

Figure 4A:
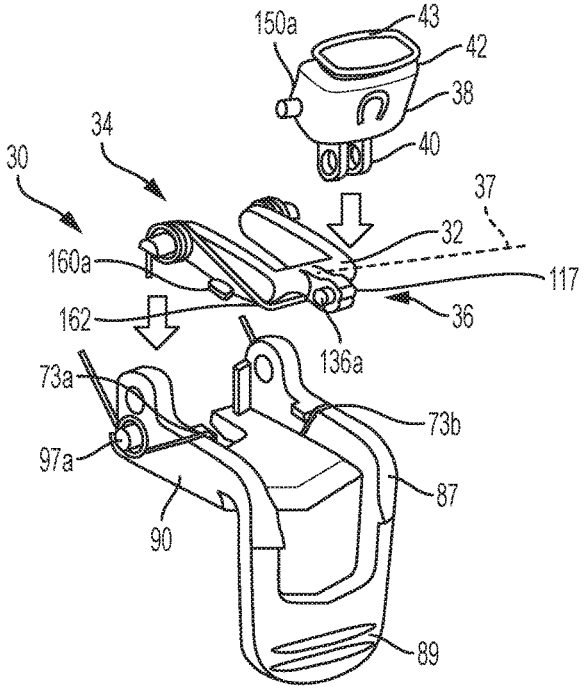
FIG. 4A is a perspective exploded view of a displaceable seal assembly of a lid assembly of FIG. 1C.
Figure 4B:
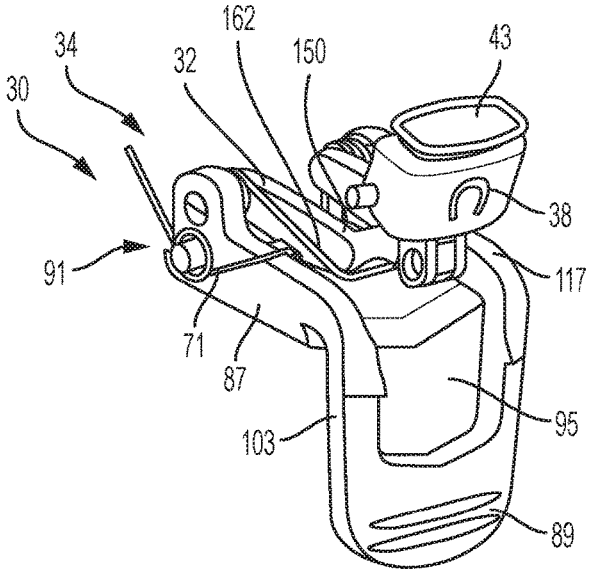
FIG. 4B is a perspective assembled view of the displaceable seal assembly of FIG. 4A.
Figure 4C:
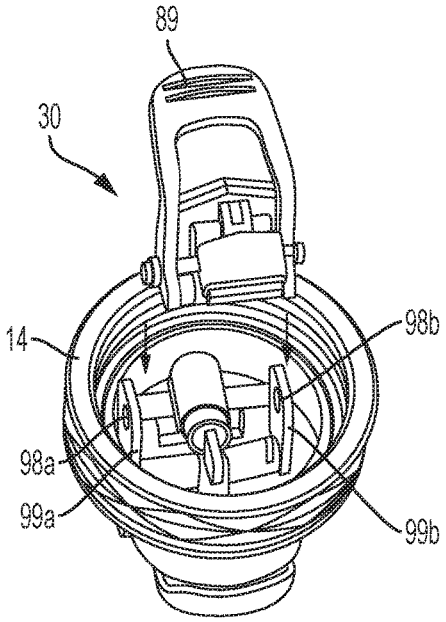
FIG. 4C is an exploded perspective view of the displaceable seal assembly of FIG. 4A, the displaceable seal assembly being separated from the base member of the lid assembly of FIG. 1C.
Figure 6A:
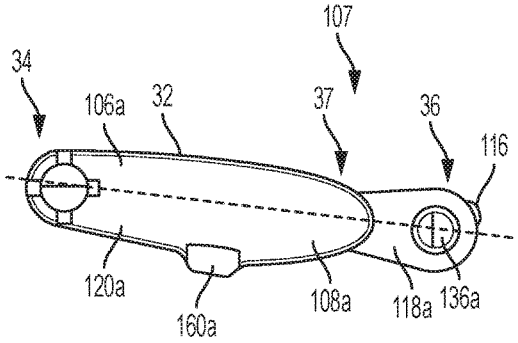
FIG. 6A is a side view of an embodiment of an intermediate arm of the displaceable seal assembly of FIG. 4A.
Figure 6B:
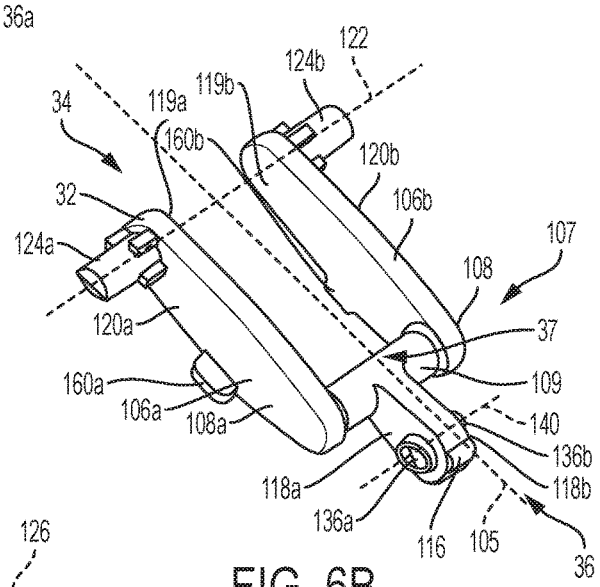
FIG. 6B is a perspective view of the intermediate arm of FIG. 6A.

As illustrated in FIGS. 2 and 4A to 4D, the lid assembly 10 also includes the displaceable seal assembly 30 directly or indirectly coupled to the base portion 14 and displaceable from the closed first position (illustrated in FIG. 3A) to the open second position (illustrated in FIG. 3B). The displaceable seal assembly 30 includes an elongated intermediate arm 32 (illustrated also in FIGS. 6A and 6B) having a first end 34 and a second end 36, the intermediate arm 32 being pivotably coupled to the base portion 14 at or adjacent to the first end 34 of the intermediate arm 32 (as illustrated in FIGS. 4A and 4B). As illustrated in FIG. 6B, the intermediate arm 32 has an engagement portion 37 disposed at or adjacent to the second end 36 of the intermediate arm 32 or between the first end 34 and the second end 36 of the intermediate arm 32.

Referring to FIG. 4A, the displaceable seal assembly 30 also includes a plunger arm 38 extending from a first end 40 to a second end 42, the first end 40 of the plunger arm 38 being pivotably coupled to the second end 36 of the intermediate arm 32. A seal member 43 is disposed at or adjacent to the second end 42 of the plunger arm 38. The seal member 43 is adapted to sealingly engage a sealing surface on an inner surface of the spout 15 adjacent to the fluid aperture 18 when the displaceable seal assembly 30 is in the closed first position (see FIGS. 2 and 3A) and adapted to be spaced apart from the sealing surface of the spout 15 when the displaceable seal assembly 30 is in the open second position (see FIG. 3B).

Figure 4D:
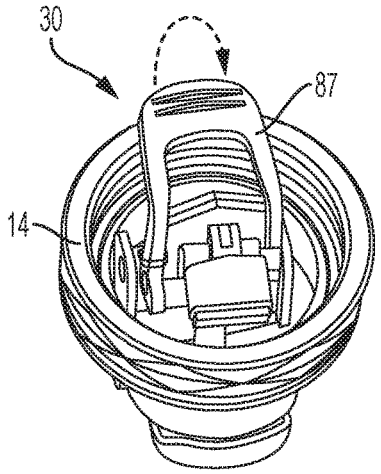
FIG. 4D is a perspective assembled view of the displaceable seal assembly of FIG. 4A with a locking member in an unsecured second position.

The displaceable seal assembly 30 may also include a locking member 87 that may be pivotably coupled to the base portion 14, and the locking member 87 may be pivotable from a locked first position (see FIGS. 2 and 3A) into an unlocked or unsecured second position (illustrated in FIG. 4D). In some embodiments, the first end 34 of the intermediate arm 32 may be pivotably coupled to a portion of the locking member 87. So configured, the locking member 87, with the intermediate arm 32 and plunger arm 38 attached thereto, can be pivoted form the first locked position to the second unlocked position, thereby allowing debris and bacteria to be cleaned from the displaceable seal assembly 30 and/or the spout 15 and/or the inside of the base portion 14. When cleaning is complete, the locking member 87, with the intermediate arm 32 and plunger arm 38 attached thereto, can be pivoted form the second unlocked position to the first locked position for use. In the first locked position, the locking member provides a physical barrier that prevents ice from interfering with the operation of the displaceable seal assembly 30 (e.g., becoming wedged between parts or between the fluid aperture 18 and the seal member 43), which could prevent or inhibit proper sealing.

In addition, as illustrated in FIG. 3B, the engagement portion 37 of the intermediate arm 32 is adapted to be contacted by the first end 26 of the button member 20 such that when the button member 20 displaces from the unactuated first position to the actuated second position, the first end 26 of the button member 20 (e.g., a planar contact surface 115, as illustrated in FIG. 1D) contacts the engagement portion 37 of the intermediate arm 32 and pivots the intermediate arm 32 about the first end 34 of the intermediate arm 32 such that the plunger arm 38 translates towards the fluid aperture 18 (e.g., substantially along the spout axis 49) from the closed first position to the open second position. This mechanism allows the plunger arm 38 (and the seal member 43) to reliably and easily extend upwardly and downwardly within the spout 15 without interference from ice or other debris. In addition, contact is reliably maintained between the planar contact surface 115 (FIG. 1D) and a surface of the engagement portion 37 of the intermediate arm 32. Moreover, the downward movement of the plunger arm 38 is relatively small, thereby preventing large chunks of ice from becoming lodged within the spout 15 between the seal member 43 and the top portion 50 of the spout 15. Furthermore, the plunger arm is shaped to allow unobstructed flow through the fluid aperture when the displaceable seal assembly 30 is in the open second position. Still further, this configuration facilitates the plunger arm 38, and thus the seal member 43, moving upward within the spout 15 to seal the fluid aperture 18 in the high drink interface lid assembly 10.

Turning to the lid assembly 10 in more detail, and referring to FIG. 1A, the base portion 14 may have any suitable shape or combination of shapes to allow the base portion 14 to act as a support for the button member 20 and/or the displaceable seal assembly 30 and to provide a barrier between an interior of the container 12 (illustrated in FIG. 10) and the outside of the lid assembly 10. The base portion 14 may generally extend from a first end 59 to an open second end 60 along a reference axis 61, and the reference axis 61 may generally extend in a vertical or substantially vertical direction when the container 12 is in a vertical (i.e., upright) orientation. The base portion 14 may include the spout 15, which may be elongated and may generally extend along the spout axis 49 from a first end 52 to a second end 54. The first end 52 of the spout 15 may be at or adjacent to the first end 59 of the base portion 14 and the second end 54 of the spout 15 may be disposed between the first end 59 and the second end 60 of the base portion 14. The spout axis 49 may be parallel to or substantially parallel to the reference axis 61, but in some embodiments, the spout axis 49 may be disposed at an angle (e.g., an acute angle) relative to the reference axis 61. For example, the spout axis 49 may form an angle between 0° and 45° (e.g., an angle between 0° and 10°) with the reference axis 61. In addition, the spout axis 49 may be radially offset from the reference axis 61. The base portion 14 may have any suitable shape when viewed along the reference axis 61. For example, as illustrated in FIG. 1B, the base portion 14 may have the shape of a circle, and the circle may be coaxially aligned with the reference axis 61.

Referring to FIG. 1D, the spout 15 may be defined by a plurality of walls 16, and the plurality of walls 16 may each have an interior surface 17. The plurality of interior surfaces 17 may cooperate to define an interior volume 46 of the spout 15. Each of the one or more walls 16 and interior surfaces 17 may have any suitable shape or combination of shapes. For example, any or all of the plurality of walls 16 and interior surfaces 17 may have one or more contoured portions and/or one or more planar portions. A cross-sectional shape of the one or more walls 16 and/or internal surfaces 17 (when viewed along the spout axis 49) may have any suitable shape or combination of shapes. For example, the one or more wall 16 and/or internal surfaces 17 may have the shape of an oval or a rectangle having rounded corners.

Referring to FIG. 1A, the top portion 50 of the spout 15 may be at or adjacent to the first end 52 of the spout 15 and/or at or adjacent to the first end 59 of the base portion 14 to provide the user with a high drink interface when drinking liquids stored in the container 12. The fluid aperture 18 may extend through the top portion 50 such that the fluid disposed within the interior of the container 12 may travel through the interior volume 46 and through the fluid aperture 18 when the displaceable seal assembly 30 is in the open second position.

As illustrated in FIGS. 1C and 2, a spout cover 56 may be pivotably coupled to a portion of the base portion 14, and the spout cover 56 may be pivoted from a drinking position (illustrated in FIG. 2) to a storage position (illustrated in FIG. 1C) in which the a concave cup member 57 covers the top portion 50 of the spout 15 to keep the top portion 50 free of dirt and debris. A portion of the cup member 57 may be disposed within a recess 58 (see FIG. 1C) formed in the base portion 14 when the spout cover 56 is in the drinking position.

As illustrated in FIGS. 1A and 1D, the base portion 14 may also include the skirt portion 19 that may extend along the reference axis 61 from an intermediate point 62 to the second end 60 of the base portion 14. The intermediate point 62 may be disposed between the second end 54 of the spout 15 and the second end 60 of the base portion 14. As shown in FIG. 1D, the skirt portion 19 may be at least partially defined by an interior surface 63 and an exterior surface 64, and the interior surface 63 and the exterior surface 64 may cooperate to form a cylindrical shape that is coaxially aligned with the reference axis 61. All or a portion of the interior surface 63 may comprise the threaded surface 24 that may be adapted to engage the threaded portion (not shown) of the container 12. An elastomeric overmold 67 may be disposed around all or a portion of the exterior surface 64. A cylindrical inner lip 65 may be radially and inwardly offset from the interior surface 63 of the skirt portion 19 to provide a gap 66 in which a circumferential top portion of the container 12 may be disposed when the lid assembly 10 is secured to the container 12. A circumferential seal (not shown) may be disposed within the gap 66 above the threaded surface 24 to prevent leakage when the lid assembly 10 is secured to the container 12.

Referring again to FIG. 1D, a button aperture 31 may be defined in base portion 14, and a portion of the button aperture 31 may extend through the skirt portion 19. The button aperture 31 may be adapted to receive a portion of the button member 20 in a manner that will be described in more detail below. The button aperture 31 may extend along the button axis 22, and the button axis 22 may be normal to (and may intersect) the reference axis 61 and/or the spout axis 49. In some embodiments, button axis 22 may be non-parallel to the spout axis 49 and may form an angle between 90° and 45° (e.g., 90° and 80°) with the spout axis 49. The button aperture 31 may be partially defined by an inner surface 68 of a projection 69 that may extend along the button axis 22. The inner surface 68 may have any suitable shape, and may be cylindrical. The base portion 14 may be a single part or may be an assembly of two or more parts that cooperate to form the base portion 14.

Figure 9A:
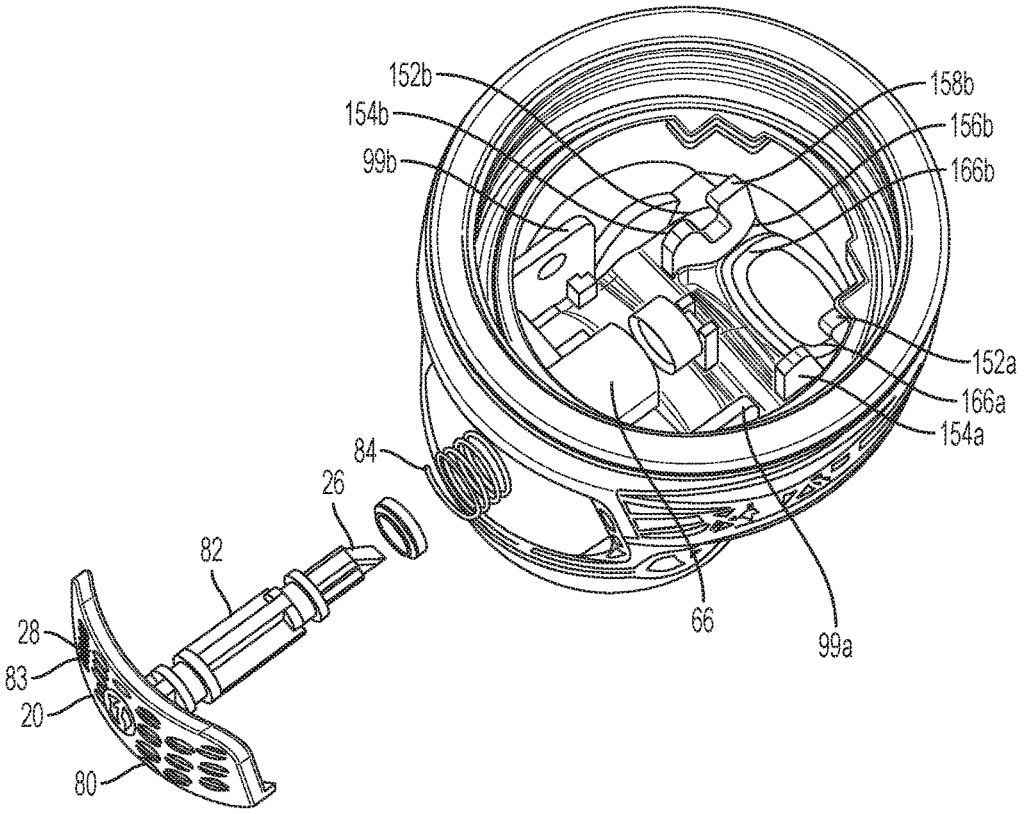
FIG. 9A is an exploded perspective view of the base portion and the button member of the lid assembly of FIG. 1C.
Figure 9B:
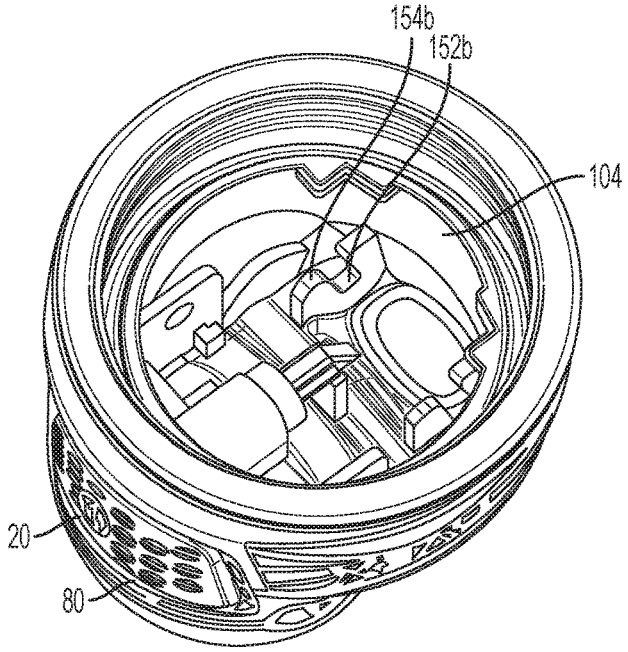
FIG. 9B is a perspective assembled view of the base portion and the button member of FIG. 9A.
Figure 11:
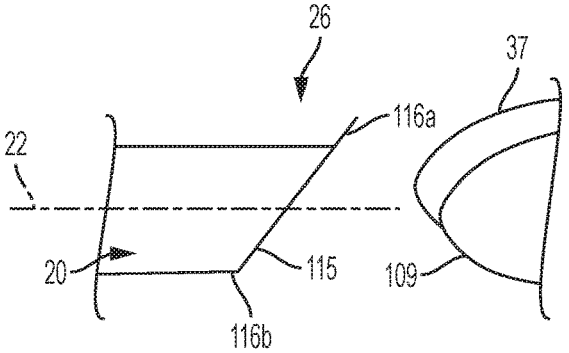
FIG. 11 is a side view of a first end of the button member of FIGS. 9A and 9B.

As illustrated in FIGS. 1D, 9A, and 9B, the lid assembly 10 may also include the button member 20 extending along the button axis 22 from the first end 26 to the second end 28, and the button member 20 may be elongated along the button axis 22. As illustrated in FIG. 9A, the button member 20 may have an interface portion 80 at or adjacent to the second end 28 and a main portion 82 extending from the interface portion to the first end 26. The interface portion 80 may have a height and width that is each greater than a corresponding height and width of the main portion 82. The interface portion 80, as illustrated in FIG. 9A, may have a contoured or curved outer surface 83 that may generally correspond to the curvature of the exterior surface 64 of the skirt portion 19. The interface portion 80 may be dimensioned and positioned to be engaged by one or more fingers of a user to inwardly depress the button member 20 to translate the button member 20 from the un-actuated first position to the actuated second position. The main portion 82 may have any suitable cross sectional shape or combination of shapes. For example, the main portion 82 may be cylindrical, substantially cylindrical, or may have an irregular shape that forms the general shape of a cylinder. As illustrated in FIGS. 3A and 3B, at least a portion of the main portion 82 may be disposed within the button aperture 31 defined by the inner surface 68 of the projection 69, and the main portion 82 may be slidable relative to the inner surface 68 of the projection 69 along the button axis 22 from the un-actuated first position to the actuated second position. As illustrated in FIG. 1D, the contact surface 115 may be disposed at the first end 26 of the button member 20 (i.e., at the at the first end 26 of the main portion 82), and the contact surface 115 may have any shape or combination of shapes capable of guiding a surface of the engagement portion 37 in a direction that rotates the intermediate arm 32 away from the aperture 18. For example, the contact surface 115 may be planar and may be disposed at a non-orthogonal angle to the button axis 22. More specifically, as illustrated in FIG. 11, when viewed normal to the button axis 22, a top portion 116*a* of the contact surface 115 extends beyond (i.e., farther from the second end 28 of the button member 20 along the button axis 22) than a bottom portion 116*b* of the contact surface 115. A biasing member 81, such as a coil spring, may be disposed between the interface portion 80 and the base portion 14 to bias the button member 20 in the un-actuated first position, as illustrated in FIG. 1D. In the actuated second position, as illustrated in FIG. 3B, an inner surface of the interface portion 80 may contact a portion of the base portion 14 adjacent to the button aperture to limit displacement towards the engagement portion 37 along the button axis 22. The biasing member 81 provides enough force to prevent the button member 20 from being accidentally actuated, while providing a small enough force that the button member 20 can be easily activated by the use when desired. In some embodiments, the biasing member 81 provides an activation force of between 1 kgF and 3 kgF.

Figure 8A:
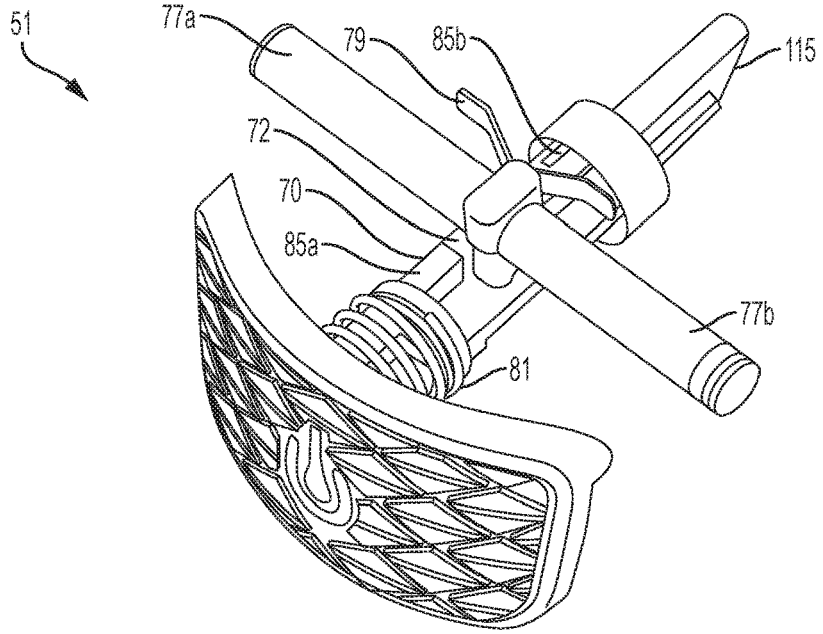
FIG. 8A is an perspective view of an embodiment of a locking assembly and a button member of the lid assembly of FIG. 1C, the button member being in an unlocked configuration.
Figure 8B:
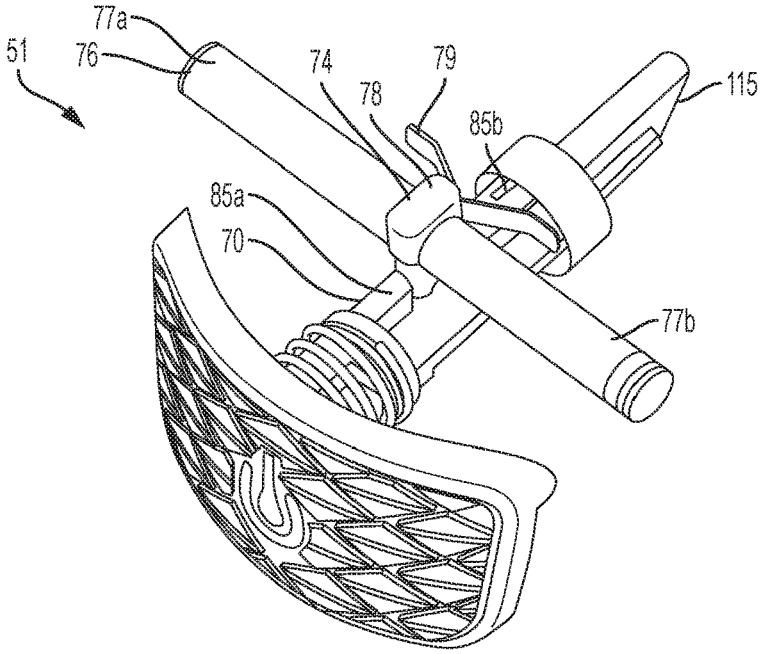
FIG. 8B is an perspective view of an embodiment of a locking assembly and a button member of the lid assembly of FIG. 1C, the button member being in a locked configuration.

Referring to FIGS. 8A and 8B, the lid assembly may include a locking assembly 51 adapted to selectively lock to prevent accidental displacement of the button member 20. The locking assembly 51 may include a first engagement portion 70 may be formed over a portion of the main portion 82. Specifically, the first engagement portion 70 may be a longitudinal gap 72 formed between a pair of longitudinally-aligned elongated walls 85*a*, 85*b*, and the elongated walls 85*a*, 85*b* may have a width that is less than (e.g., 25% to 50% less than) the diameter or width of the main portion 82. The longitudinal gap 72 may be sized to receive all or part of second engagement portion 74 that may be disposed on a locking shaft 76, and the second engagement portion 74 may be a substantially rectangular elongated block 78 that may have a width approximately equal to the width of the elongated walls 85*a*, 85*b* and a longitudinal length slightly smaller than the longitudinal gap 72. Each of a first end 77*a* and a second end 77*b* of a locking shaft 76 may be slidably received in a corresponding portion of a tubular shaft guide 78 (illustrated in FIGS. 1D and 4C) of the base portion 14 such that each of the first end 77*a* and the second end 77*b* of the locking shaft 76 are accessible to a user (e.g., protrude slightly outward of an external surface of the base portion 14). In a first locked position illustrated in FIG. 8B, the first engagement portion 70 engages the second engagement portion 74 to prevent or limit displacement of the button member 20 from the un-actuated first position to (or towards) the actuated second position. For example, the locking shaft 76 may be displaced along its axis in a first direction (e.g., by the finger of a user) such that the elongated block 78 is longitudinally aligned (along the button axis 22) with each of the elongated walls 85*a*, 85*b* and is disposed within the longitudinal gap 72. In such a position, the elongated block 78 engaging the at least one of the elongated walls 85*a*, 85*b* to prevent displacement of the button member 20 along the button axis 22.

To unlock the button member 20, the locking shaft 76 may be displaced to a second unlocked position illustrated in FIG. 8A in which the first engagement portion 70 does not engage the second engagement portion 74, thereby allowing displacement of the button member 20 from the un-actuated first position to (or towards) the actuated second position. A leaf spring member 79 may be secured to a portion of the base portion 14 adjacent to the elongated block 78 to provide a detent action.

The first engagement portion 70 may include any feature or combination of features that can engage with the second engagement portion 74 to prevent or limit displacement of the button member 20 from the un-actuated first position to (or towards) the actuated second position. For example, the first engagement portion 70 may be a projection or tab that may be received in a second engagement portion 74 that may be a recess, channel, or gap.

As illustrated in FIG. 3A, the main portion 82 may also include a seal recess 86 that may be formed over a portion (or the entire) circumference of the main portion 82. The seal recess 86 may be disposed between the longitudinal gap 72 and the first end 26 of the button member 20. An inner portion of a circumferential seal 88 may be disposed within the seal recess 86 and an outer portion of the seal 88 may extend radially beyond the seal recess 86. The seal 88 may be sized and positioned such that when the button member 20 is in the closed first position (illustrated in FIG. 3A), the seal 88 abuts and sealingly engages an end portion 93 of the projection 69 defining the button aperture 31, thereby preventing leaks through the button aperture 31.

When the button member 20 is initially displaced from the un-actuated first position to the actuated second position, the seal 88 briefly disengages the end portion 93 of the projection 69 prior to the second end 26 of the button member 20 engaging the engagement portion 37 of the intermediate arm 32 (and thus displacing the seal member 43 from the aperture 18), and this brief displacement of the seal 88 allows gas and/or vapor to vent through the button aperture 31 (and to a desired exit 89 formed in a portion of the base portion 14 within the recess 58, illustrated in FIG. 3B) before the seal member 43 is displaced from the aperture 18. This venting prevents the gas and/or vapor from exiting the aperture 18 when the seal member 43 is downwardly displaced, thereby avoiding splashing and/or scalding of a user's face.

Figure 5A:
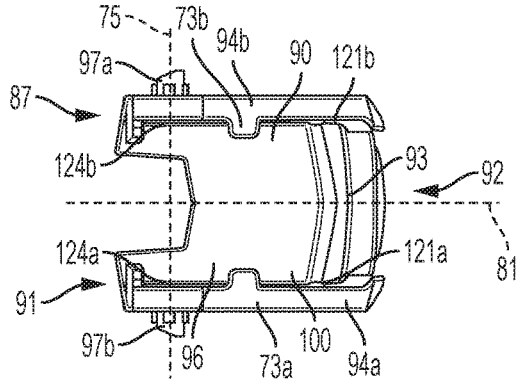
FIG. 5A is a top view of the locking member of the displaceable seal assembly of FIG. 4A.
Figure 5B:
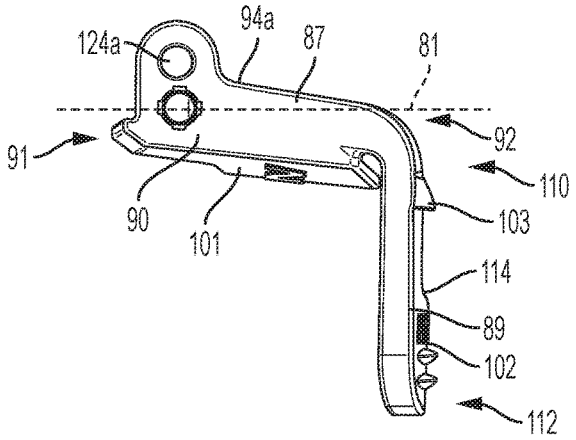
FIG. 5B is a side view of the locking member of FIG. 5A.

As illustrated in FIGS. 3A, 3B, the lid assembly 10 may also include the displaceable seal assembly 30, and the displaceable seal assembly 30 may include a locking member 87 that may be pivotable from a locked first position (see FIGS. 2 and 3A) into an unlocked or unsecured second position (illustrated in FIG. 4D) that allows for the cleaning of portions of the displaceable seal assembly 30, portions of the base member 14, and/or portions of the fluid aperture 18, for example. As illustrated in FIGS. 5A and 5B, the locking member 87 may include a support portion 90 that may be elongated and may extend along a longitudinal axis 81 from a first end 91 to a longitudinally-opposite second end 92. An intermediate portion 93 may be disposed between the first end 91 and the second end 92.

The support portion 90 may have a first arm 94*a* and a second arm 94*b* that extend along the longitudinal axis 81, and a plate portion 96 may extend between the first and second arms 94*a*, 94*b*. The plate portion 96 may have a top surface 100 and an opposite bottom surface 101. A window 95 may be disposed within or through the locking member 87 (e.g. the support portion 90), and the window 95 may longitudinally extend from a first point at or adjacent to the intermediate portion 93 to a second point at or adjacent to the second end 92 of the support portion 90. The locking member 87 may be slightly cambered or curved when viewed along the longitudinal axis 81. A top portion of each of the first arm 94*a* and the second arm 94*b* may be offset from the top surface 100 of the plate portion 96 in a direction normal to the longitudinal axis 81. A first and second stop tab 73*a*, 73*b* may inwardly extend from a top portion of each of the first arm 94*a* and the second arm 94*b*, respectively.

The locking member 87 (e.g., the first end 91 of the support portion 90) may be pivotably coupled to a portion of the base portion 14. More specifically, a portion of the locking 90 member adjacent to the first end 91 may be pivotably coupled to a portion of the base portion 14. For example, as illustrated in FIG. 5A, a pair of projections 97*a*, 97*b* may each outwardly extend from each of the first arm 94*a* and a second arm 94*b* along the axis of rotation 75 from a point at the first end 91 of the support portion 90 of the locking member 87, and each projection 97*a*, 97*b* may be rotatably received in an aperture 98*a*, 98*b* of a corresponding support tab 99*a*, 99*b* (see FIG. 4C) secured to or formed with an inner surface of the base portion 14.

The locking member 87 (i.e., the support portion 90) may be pivotable about the axis of rotation 75 from the closed first position (illustrated in FIGS. 2 and 3A) to an unlocked or unsecured second position (illustrated in FIG. 4D). In the closed first position, the top surface 100 faces the aperture 18 formed in the top portion 50 of the spout 15 of the base portion 14. The axis of rotation 75 may be normal to the longitudinal axis 81 of the support portion 90, and the axis of rotation 75 may also be normal to the button axis 22 of the button member 20. As illustrated in FIG. 4A, a biasing member 71 may be disposed around each projection 97*a*, 97*b* and may contact a portion of the base member 14 and the support portion 90 to bias the locking member into the closed first position.

Figure 5C:
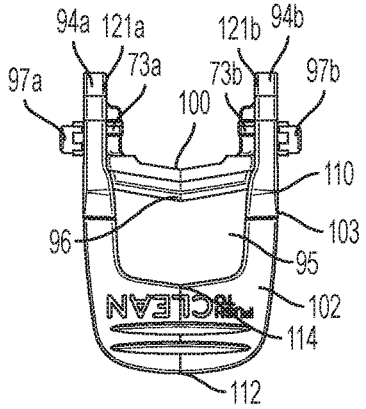
FIG. 5C is a front view of the locking member of FIG. 5A.

As illustrated in FIGS. 5B and 5C, the locking member 87 may also include a locking tab 89 disposed at or adjacent to the second end 92 of the support portion 90, and the locking tab 89 may extend from the second end 92 of the support portion 90 in a direction normal or generally normal to the longitudinal axis 81. The locking tab 89 may extend from a first end 110 to a second end 112, and the first end 110 may be adjacent to the second end 92 of the support portion 90. A portion of the window 95 may extend through the locking tab 89 from the first end 110 to a point 114 between the first end 110 and the second end 112.

As illustrated in FIG. 5B, the locking tab 89 may have an outer surface 102 having one or more (e.g., a pair of) ribs 103 on opposite sides of the window 95 that are adapted to engage a corresponding rib 104 (see FIG. 9B) or ribs of the base portion 14 when the locking member 87 is in the closed first position to releasably maintain the locking member 87 is in the closed first position. To rotationally displace the locking member 87 from the closed first position (of FIG. 2) to the unlocked second position (of FIG. 4D), the locking tab 89 may first be displaced by the user towards the first end 91 of the support portion 90 such that the each of the ribs 103 clears the rib 104 of the base portion 14 prior to rotation about the axis of rotation 75. In the unlocked second position, components of the displaceable seal assembly 30, for example, may be cleaned. The locking member 87 may then be rotated from the unlocked second position to the closed first position by reversing the process. To facilitate the user accessing the locking tab 89, an end portion of the locking tab 89 may extend beyond the second end 60 of the base portion 14.

As illustrated in FIGS. 2 and 4A to 4D, the displaceable seal assembly 30 is coupled to the base portion 14 and displaceable from the closed first position (illustrated in FIG. 3A) to the open second position (illustrated in FIG. 3B). Referring to FIG. 4A, which shows only the displaceable seal assembly 30 in an exploded view for clarity, the displaceable seal assembly 30 includes the elongated intermediate arm 32 and the plunger arm 38 coupled to the intermediate arm 32. As illustrated in FIGS. 6A and 6B, the intermediate arm 32 extends along a first arm axis 105 from the first end 34 to the second end 36. The intermediate arm 32 includes a pair of arms 106*a*, 106*b* that extend along the first arm axis 105 from the first end 34 to an intermediate point 107 between the first end 34 and the second end 36, and the arms 106*a*, 106*b* are offset in a direction normal to the first arm axis 105. An outwardly-disposed outer surface 120*a*, 120*b* of each of the arms 106*a*, 106*b* may be separated by a distance (normal to the first arm axis 105) that may be less than a distance separating an inwardly-disposed inner surface 121*a*, 121*b* of each of the first arm 94*a* and second arm 94*b* of the locking member 87 (illustrated in FIG. 5A). As illustrated in FIG. 6B, a first and second stop tab 160*a*, 160*b* may outwardly extend from a bottom portion of each of the outer surfaces 120*a*, 120*b*, respectively, of each of the arms 106*a*, 106*b*, respectively. Each of the stop tabs 160*a*, 160*b* of the arms 106*a*, 106*b* may engage the respective first and second stop tab 73*a*, 73*b* of each of the first arm 94*a* and the second arm 94*b*, respectively, (see FIG. 5C) of the support portion 90 of the locking member 87.

The intermediate arm 32 may also include a transverse portion 109 that may extend between an end portion 108*a*, 108*b* (or adjacent to the end portion 108*a*, 108*b*) of each of the pair of arms 106*a*, 106*b*, and the transverse portion 109 may be elongated and extend along an axis that is normal to the first arm axis 105. The end portions 108*a*, 108*b* may each be aligned with (or disposed at or adjacent to) the intermediate point 107 disposed between the first end 34 and the second end 36 of the intermediate arm 32. The transverse portion 109 may have any suitable shape or combination of shapes. For example, the transverse portion 109 may have a cylindrical or substantially cylindrical cross-sectional shape. The intermediate arm 32 may also include an extension tab 117, and the extension tab 117 may extend along the first arm axis 105 from a center portion of the transverse portion 109 to the second end 36 of the intermediate arm 32. The extension tab 117 may be planar and may be defined by a pair of walls 118*a*, 118*b* that may each be disposed inward of (and parallel to) corresponding inner surfaces 119*a*, 119*b* of each of the arms 106*a*, 106*b*.

The intermediate arm 32 also includes an engagement portion 107 that may be disposed at any portion of or location on the intermediate arm 32 capable of contacting the first end 26 of the button member 20 in a manner that results in a rotation of the intermediate arm 32 about a rotational axis 122 disposed at or adjacent to the first end 34 of the intermediate arm 32, and the rotational axis 122 may be normal to the first arm axis 105 and/or to the button axis 22. For example, the engagement portion 37 may be a portion or a surface (e.g., an angled or cylindrical surface) of the transverse portion 109. However, the engagement portion 37 may be an upwardly-projecting portion of the extension tab 117.

The intermediate arm 32 may be pivotably directly or indirectly coupled to the base member 14 in any suitable manner to allow the first end 34 of the intermediate arm 32 to pivot about the rotational axis 122. For example, the intermediate arm 32 may be pivotably coupled to the locking member 87 which itself may be coupled to the base member 14. Specifically, as illustrated in FIG. 6B, the intermediate arm 32 may be pivotably coupled to the locking member 87, and a pair of projections 124*a*, 124*b* may each outwardly extend from each of the pair of arms 106*a*, 106*b*. Each of the pair of projections 124*a*, 124*b* may extend along the axis of rotation 122. Each projection 124*a*, 124*b* may be rotatably received in an aperture 126*a*, 126*b* (see FIGS. 5A and 5B) formed in a corresponding first arm 94*a* and second arm 94*b* (see FIG. 4C) formed at or adjacent to the first end 91 of the support portion 90 of the locking member 47.

Figure 7A:
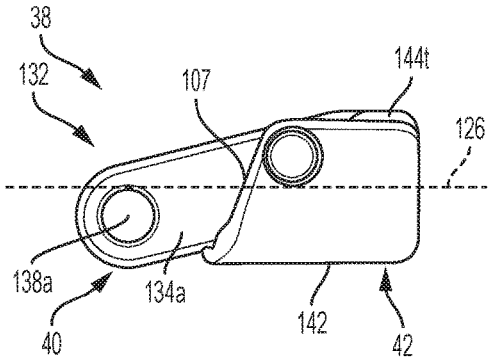
FIG. 7A is a side view of an embodiment of a plunger arm of the displaceable seal assembly of FIG. 4A.
Figure 7B:
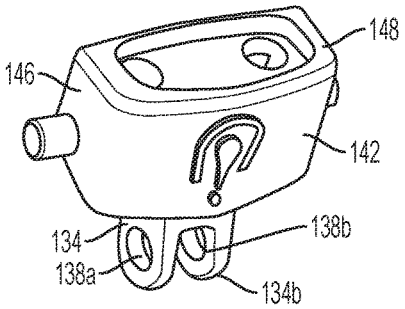
FIG. 7B is a perspective view of the plunger arm of FIG. 7A.
Figure 7C:
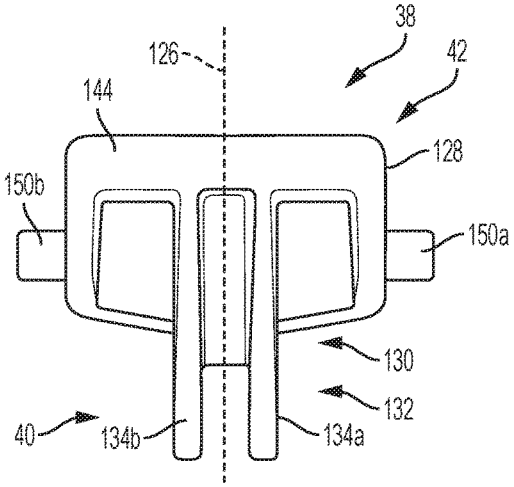
FIG. 7C is a rear view of the plunger arm of FIG. 7A.

As illustrated in FIGS. 4A and 7A to 7C, the displaceable seal assembly 30 may also include the elongated plunger arm 38 extending from the first end 40 to the second end 42 along a second arm axis 126 (illustrated in FIG. 7C), and the first end 40 of the plunger arm 38 is pivotably coupled to the second end 36 of the intermediate arm 32. More specifically, as illustrated in FIG. 7C, the plunger arm 38 may include a support portion 128 that longitudinally extends from the first end 42 to an intermediate point 130, and a cross-sectional shape of the support portion 128 may be rectangular. The plunger arm 38 (e.g., the support portion 128) may be so shaped and dimensioned to allow maximum flow around the plunger arm 38 when the displaceable seal assembly 30 is in the open second position. As illustrated in FIG. 7C, the plunger arm 38 (e.g., the support portion 128) may include a first guide projection 150*a* a second guide projection 150*b* that are each adapted to engage (or be slidingly disposed within) corresponding guide slots 152*a*, 152*b* formed in guide tabs 154*a*, 154*b* (illustrated in FIG. 9B) coupled to the spout 15 (e.g., formed on the base portion 14 at least partially within the interior volume 46 of the spout 15). As illustrated in FIG. 9B, the pair of planar guide tabs 154*a*, 154*b* may be coupled to the spout 15 of the base portion 14 in any suitable manner, and the first and second guide projections 150*a*, 150*b* and the corresponding guide slots 152*a*, 152*b* cooperate to guide the plunger arm 38 along a desired path when the displaceable seal assembly 30 is displaced from the closed first position to the open second position. More specifically, each guide tab 154*a*, 154*b* may extend from one or more of the interior surface 17 of the plurality of walls 16 forming the spout 15. As illustrated in FIG. 9A, the guide tabs 154*a*, 154*b* may each be equidistant from the button axis 22. Each guide tab 154*a*, 154*b* may extend from a first end 156*a*, 156*b* to a second end 158*a*, 158*b*, and the first end 156*a*, 156*b* may be at or adjacent to a corresponding end portion 166*a*, 166*b* of the fluid aperture 18. The second end 158*a*, 158*b* may be disposed at a point between the first end 156*a*, 156*b* and the button axis 22. Each guide slot 152*a*, 152*b* may extend from the second end 158*a*, 158*b* of the guide tab guide tab 154*a*, 154*b* towards the first end 156*a*, 156*b* such that the guide slot 152*a*, 152*b* is open and unobstructed at the second end of the guide tab 154*a*, 154*b*.

Turning back to the first and second guide projection 150*a*, 150*b* of the plunger arm 38, the support portion 128 may include a front surface 142 and rear surface 144, a first sidewall 146, and a second sidewall 148, as illustrated in FIGS. 7A to 7C. The first sidewall 146 and the second sidewall 148 may be parallel and may extend along the second arm axis 126. The first guide projection 150*a* may extend from the first sidewall 146 and the second guide projection 150*b* may extend from the second sidewall 148, and both the first and second guide projections 150*a*, 150*b* may be coaxially-aligned with a reference axis that is normal to the second arm axis 126.

The plunger arm 38 may also include a coupling portion 132 that is coupled to the support portion 128 and that extends along the second arm axis 126 from the intermediate point 130 to the first end 40. The coupling portion 132 may include two plate-shaped tabs 134*a*, 134*b* that surround the extension tab 117 of the intermediate arm 32. The first end 40 of the plunger arm 38 may be pivotably coupled to the second end 36 of the intermediate arm 32 in any suitable manner. For example, as illustrated in FIG. 6B, a pair of projections 136*a*, 136*b* may each outwardly extend from a corresponding wall 118*a*, 118*b* of the extension tab 117 of the intermediate arm 32 in a direction parallel to the axis of rotation 122 of the intermediate arm 32. Each projection 136*a*, 136*b* may be rotatably received in an aperture 138*a*, 138*b* (see FIG. 7B) formed in a corresponding tab 134*a*, 134*b* of the coupling portion 132. So configured, the first end 40 of the plunger arm 38 may be pivotably coupled to the second end 36 of the intermediate arm 32 to rotate about an axis of rotation 140 (illustrated in FIG. 6B) coaxially-aligned with the pair of projections 136*a*, 136*b* of the extension tab 117 of the intermediate arm 32. The first and second guide projections 150*a*, 150*b* may be coaxially-aligned with a reference axis that is parallel to the axis or rotation 140.

As illustrated in FIG. 4A, a biasing member 162 may be disposed around each projection 124*a*, 124*b* and may contact a portion of the locking member 87 and transverse portion 109 of the intermediate arm 32 (and/or the extension tab 117 of the intermediate arm 32) to bias the intermediate arm 32 (and the plunger arm 38) in the closed first position. So biased, the rotation (or further rotation) of the intermediate arm 32 relative to the locking member 87 about the rotational axis 122 is limited or prevented when each of the stop tabs 160*a*, 160*b* of the arms 106*a*, 196*b* of the intermediate arm 32 (see FIGS. 4A and 6B) engages the respective first and second stop tab 73*a*, 73*b* of each of the first arm 94*a* and the second arm 94*b*, respectively, (see FIG. 5C) of the support portion 90 of the locking member 87. Rotation of the intermediate arm 32 relative to the locking member 87 about the rotational axis 122 is limited in a direction opposite to the biasing force by contact between the intermediate arm 32 and the support portion 90 (e.g., the top surface 100 of the plate portion 96 of the support portion 90).

As illustrated in FIG. 4A, the seal member 43 is disposed at or adjacent to the second end 42 of the plunger arm 38. The seal member 43 may be made of an elastomeric material that may be coupled to the second end 42 of the plunger arm 38. The seal member 43 may have an shape that allows the seal member 43 to sealingly engage a portion of the spout 15 adjacent to the fluid aperture 18 when the displaceable seal assembly 30 is in the closed first position. For example, the seal member 43 may have the general shape of—but may be slightly larger than—the fluid aperture 18, but the seal member 43 may be slightly larger than the fluid aperture 18.

As previously explained, each guide slot 152*a*, 152*b* may extend from the second end 158*a*, 158*b* of the guide tab guide tab 154*a*, 154*b* towards the first end 156*a*, 156*b* such that the guide slot 152*a*, 152*b* is open and unobstructed at the second end of the guide tab 154*a*, 154*b*. As such, when the locking tab 87 pivoted from the locked first position (see FIGS. 2 and 3A) to the unlocked or unsecured second position (illustrated in FIG. 4D), the plunger arm 38 can be easily removed from the guide tabs 154*a*, 154*b* and thus decoupled from the base portion 14. In addition, when the locking tab 87 pivoted from the unlocked second position to the locked first position, gravity maintains the plunger arm 38 in a position in which the first and second guide projections 150*a*, 150*b* are aligned with the second end of the guide tab 154*a*, 154*b* to ensure that the first and second guide projections 150*a*, 150*b* enter the corresponding guide slots 152*a*, 152*b*. Such a configuration allows the displaceable seal assembly 30 and/or base portion 14 to be easily cleaned and reassembled by a user. Each guide slot 152*a*, 152*b* may extend along a path that is generally vertical, but may not be parallel to the spout axis 49 and/or the reference axis 61 of the base portion 14. Furthermore, by configuring the plunger arm 38 to be pivotable relative to the intermediate arm 30, and by configuring the intermediate arm 30 to be pivotable relative to the base portion 14, pivoting of the intermediate arm 30 translates into mostly vertical motion of the plunger arm 38. As a result, the seal assembly 30 provides substantially more vertical motion for the plunger arm 38, without a corresponding increase in the size of the seal assembly 30, compared to known lids. As a result, the seal assembly 30 is more effective in allowing the plunger arm 38, and thus the seal member 43 to reach the fluid aperture 18, which is part of a high drink interface for the user.

Moreover, with the planar contact surface 15 rotating the intermediate arm 32 and thereby displacing the plunger arm 38 as described, the displacement of the seal member 43 along the spout axis 49 is minimized to prevent ice or other debris from becoming lodged with a gap between the seal member 43 and the top portion 50 of the spout 15 when the seal member 43 is in the open position. In addition, the cross-sectional geometry and dimensions of the plunger arm 38 relative to the spout 15 further prevents large chunks of ice from interfering with the sealing of the seal member 43 with the top portion 50 of the spout member 50.

To further assist in cleaning the displaceable seal assembly 30 the plunger arm 38 may be manually rotated about the axis of rotation 140 by a user to a stowed position (not shown) in which the rear surface 144 is adjacent to or rests on the transverse portion 109 and/or the extension tab 117 of the intermediate arm. Prior to pivoting the locking tab 87 from the unlocked second position to the locked first position, the plunger arm 38 may be manually rotated about the axis of rotation 140 to a generally upright position shown in FIG. 4B, at which point gravity maintains the plunger arm 38 in a desired position, as previously explained.

When a user desires to drink a fluid from the container 12, the user may first unlock the locking mechanism 51 as previously described and as illustrated in FIG. 8A. The user may then inwardly depress the button member 20, thereby translating the button member 20 from the un-actuated first position to the actuated second position. This displacement of the button member 20 causes the displaceable seal assembly 30 to move or transition from the closed first position to the open second position. That is, the displacement of the button member 20 causes the contact surface 115 at the first end 26 of the button member 20 to engage or contact the engagement potion 37 of the intermediate arm 32, thereby rotating the intermediate arm 32 in a first direction about the rotational axis 122 (see FIG. 6B). By the nature of the planar contact surface 115 slidingly contacting the cylindrical surface of the engagement portion, a reliable engagement is maintained going from the closed first position to the open second position (and vice versa) of the displaceable seal assembly 30. This contact translates the plunger arm 38 and the seal member 43 in a direction away from the top portion 50 of the spout 15 of the base portion 14 as previously described, thereby allowing fluid disposed within the container to flow through the fluid aperture 18.

When finished drinking, the user may release the button member 20, and the biasing member 81 translates the button member 20 from the actuated second position to the un-actuated first position. This displacement of the button member 20 causes the displaceable seal assembly 30 to move or transition from the open second position to the closed first position. That is, the displacement of the button member 20 causes the contact surface 115 at the first end 26 of the button member 20 to disengage the engagement potion 37 of the intermediate arm 32, thereby allowing the biasing member 162 (see FIG. 4B) to rotate in a second direction about the intermediate arm 32 about the rotational axis 122 (see FIG. 6B). This rotation translates the plunger arm 38 and the seam member 43 in a direction towards the top portion 50 of the spout 15 of the base portion 14 as previously described, thereby sealing the fluid aperture 18.

While various embodiments have been described above, this disclosure is not intended to be limited thereto. Variations can be made to the disclosed embodiments that are still within the scope of the appended claims.

What is claimed is:

1. A lid assembly for a container, the lid assembly comprising:

a base portion having a spout and a fluid aperture in a top portion of the spout;

a button member coupled to the base portion, the button member being longitudinally displaceable relative to the base portion between an un-actuated first position and an actuated second position; and a seal assembly coupled to the base portion and displaceable from a closed first position to an open second position, the seal assembly comprising:

an intermediate arm pivotably coupled to the base portion;

a plunger arm pivotably coupled to the intermediate arm, and a seal member disposed on the plunger arm, the seal member sealingly engaging the fluid aperture when the seal assembly is in the closed first position and the seal member being separated from the fluid aperture when the seal assembly is in the open second position, wherein the button member is adapted to contact an engagement portion of the intermediate arm to displace the seal assembly from the closed first position to the open second position, and the pivotable connection between the intermediate arm and the plunger arm is formed by an aperture and a projection that forms an axis of rotation for the plunger arm, the projection being rotatably received by the aperture.

2. The lid assembly of claim 1, wherein the seal assembly includes a locking member that is pivotably secured to a portion of the base portion and is adapted to be pivoted from a locked first position into an unlocked or unsecured second position, and wherein the intermediate arm is pivotably coupled to the locking member.

3. The lid assembly of claim 2, wherein the locking member includes a support portion extending from a first end to a second end, and a portion of the locking member adjacent to the first end is pivotably secured to the base portion.

4. The lid assembly of claim 3, wherein the locking member includes a locking tab, the locking tab having one or more ribs that releasably engage a corresponding rib of the base portion to releasably secure the locking member in the closed first position.

5. The lid assembly of claim 2, wherein a biasing member provides a biasing force on the intermediate arm to bias the second end of the intermediate arm towards the top portion of the spout when the seal assembly is in the locked position.

6. The lid assembly of claim 1, wherein the locking member is pivotable about an axis of rotation that is normal to a reference axis that is coaxially-aligned with a cylindrical skirt portion of the base portion.

7. The lid assembly of claim 1, wherein a button axis forms an angle between 90° and 45° with the spout axis, and wherein a spout axis forms angle between 0 and 45 with a reference axis that is coaxially-aligned with a cylindrical skirt portion of the base portion.

8. The lid assembly of claim 1, wherein the first end of the button member includes a planar contact surface adapted to contact the engagement portion of the intermediate arm.

9. The lid assembly of claim 1, wherein the planar contact surface is disposed at a non-orthogonal angle to the button axis.

10. The lid assembly of claim 1, further comprising a locking assembly having a first engagement portion of the button member that selectively engages a second engagement portion coupled to the base portion to prevent displacement of the button member along the button axis.

11. The lid assembly of claim 10, wherein the first engagement portion is an elongated wall and the second engagement portion is an elongated block coupled to a displaceable shaft coupled to the base portion.

12. The lid assembly of claim 1, wherein the intermediate arm includes a transverse portion extending between a pair of arms that each extend from the first end towards the second end of the intermediate arm, the engagement portion of the transverse portion is a portion of the transverse portion.

13. The lid assembly of claim 12, wherein the engagement portion is a cylindrical surface of the transverse portion of the intermediate arm.

14. The lid assembly of claim 1, wherein the plunger arm extends from a first end to a second end along a longitudinal axis, and a first guide projection and a second guide projection each extend from the plunger arm in a direction normal to the longitudinal axis of the plunger arm, and each of the first guide projection and the second guide projection are slidingly disposed within corresponding guide slots formed in guide tabs coupled to the spout of the base portion.

15. The lid assembly of claim 1, wherein the plunger arm translates substantially along a spout axis from the closed first position to the open second position as the intermediate arm pivots relative to the base portion at or adjacent to the first end of the intermediate arm.

16. The lid assembly of claim 1, wherein the base portion includes a skirt portion having an exterior surface, and wherein a portion of the exterior surface of the skirt portion is threaded for engaging a threaded portion of the container.

17. The lid assembly of claim 1, wherein a button aperture is defined in base portion, and at least a portion of the button member is disposed within the button aperture.

18. The lid assembly of claim 6, wherein the exterior surface of the skirt portion has a cylindrical shape.

19. The lid assembly of claim 1, wherein a spout axis is normal to a button axis.

20. The lid assembly of claim 1, wherein the plunger arm includes a first guide projection and a second guide projection that are adapted to engage corresponding first and second guide slots formed in first and second guide tabs coupled to a spout to guide the plunger arm along a desired path when the seal assembly is displaced from the closed first position to the open second position.

21. A lid for a container, the lid assembly comprising:

a base portion having a spout that extends along a spout axis and a fluid aperture extending through a top portion of the spout;

a button member coupled to the base portion and extending through a button aperture, the button member extending along a button axis, wherein a first end of the button member includes a planar contact surface disposed at a non-orthogonal angle to the button axis, the button axis being disposed at an angle of between 45° and 90° with the spout axis, the button member being displaceable along the button axis from an un-actuated first position to an actuated second position; and a seal assembly coupled to the base portion and displaceable from a closed first position to an open second position, the seal assembly comprising:

a locking member pivotably secured to the base portion, the locking member pivoting between a locked first position and an unlocked second position;

an intermediate arm pivotably coupled to the locking member;

a plunger arm pivotably coupled to the intermediate arm, the plunger arm including a first guide projection and a second guide projection extending normal to the longitudinal axis of the plunger arm, and a seal member disposed on the plunger arm, the seal member being adapted to sealingly engage the fluid aperture when the seal assembly is in the closed first position and the seal member is adapted to be separated from the fluid aperture when the seal assembly is in the open second position, wherein an engagement portion of the intermediate arm is adapted to be contacted by the planar contact surface of the button member, wherein the button member contacts the engagement portion of the intermediate arm and pivots the intermediate arm such that the plunger arm translates away from the fluid aperture from the closed first position to the open second position, and the pivotable connection between the intermediate arm and the plunger arm is formed by an aperture and a projection that forms an axis of rotation for the plunger arm, the projection being rotatably received by the aperture.

22. The lid of claim 21, wherein the intermediate arm includes a first stop tab and a second stop tab that extend outwardly from a bottom portion of the intermediate arm, the first stop tab and the second stop tab being configured to engage a first tab and a second tab located on the locking member.

* * * * *